US005433294A

United States Patent [19]

Walker

[11] Patent Number: 5,433,294

[45] Date of Patent: Jul. 18, 1995

[54] GEARED ELEVATOR SYSTEM

[75] Inventor: Roy J. Walker, Millington, Tenn.

[73] Assignee: Delaware Capital Formation, Inc., Wilmington, Del.

[21] Appl. No.: 245,751

[22] Filed: May 18, 1994

[51] Int. Cl.[6] ..... B66B 11/08

[52] U.S. Cl. ..... 187/254; 187/271

[58] Field of Search ..... 187/250, 251, 254, 267, 187/271

[56] References Cited

U.S. PATENT DOCUMENTS

| | | | |
|---|---|---|---|
| 1,011,423 | 12/1911 | Gale | 187/254 X |
| 1,125,133 | 1/1915 | Larsson | 187/254 X |
| 5,201,821 | 4/1993 | Ericson et al. | 187/254 X |
| 5,226,508 | 7/1993 | Ericson et al. | 187/254 |

*Primary Examiner*—William E. Terrell
*Assistant Examiner*—Dean A. Reichard
*Attorney, Agent, or Firm*—White & Case

[57] ABSTRACT

A geared traction elevator includes a worm shaft, supported by a pair of tapered roller bearings in a gear box housing, one end of which projects out of an opening in the gear box housing and is coupled to the motor. The motor end bearing assembly is secured against axial movement by a retainer ring, which is secured in a groove in the gear box housing, and the motor end of the worm shaft is sealed by a dynamic seal, also secured in the housing. A cap bears against the bearings at the other end of the shaft, to pre-load the bearings to a predetermine level. In this manner, the dynamic seal may be replaced without affecting the pre-load setting. Preferably, the bearings are disposed in openings at opposite ends of the gear box housing which are large enough to allow the worm shaft to be removed through either end. The arrangement simplifies the manufacture of the gear box, and reduces the time and parts necessary to replace the dynamic seal.

4 Claims, 4 Drawing Sheets

GEARED ELEVATOR SYSTEM

FIELD OF INVENTION

The present invention relates to geared elevator systems.

BACKGROUND OF THE INVENTION

In geared elevator systems, the motor is coupled to the drive sheave through a worm reduction gear system. In a typical worm gear drive, the worm gear shaft is supported in the gear box housing by a pair of tapered roller bearings located at either end of the gear box housing. A cap bears against the outer race of each of the roller bearings, so as to pre-load the bearings in the axial direction, toward one another, by a specified amount. The caps also contain a seal.

More particularly, the front cap, which supports the outer race of the front tapered roller bearing, covers an opening in the gear box housing and seals the front end of the gear box housing with an "O" ring seal, which is disposed in an "O" ring groove formed in the cap. The rear cap, which is located on the motor side of the gear box housing, has a hole to allow the worm shaft to pass through. The rear cap seals the gear box housing and shaft with a smooth lip, bi-rotational, hydrodynamic shaft seal.

The front and rear caps are secured to the gear box housing by a plurality of mounting bolts. The distance between the front and rear caps (which controls the amount of pre-load on the bearings) is adjusted by using shims under the front cap.

Whenever the rear seal needs to be replaced, the rear cap needs to be removed, which changes the factory pre-load setting. As a result, it is necessary to reset the pre-load on the tapered roller bearings. Typically, the replacement rear seal is shipped from the factory pre-installed in a new rear cap accompanied by a new shim package for the front cap.

In order to reset the proper load, the front seal is removed and the old shims are removed and discarded. After the new rear cap and replacement seal assembly have been mounted onto the gear box housing, and the mounting bolts have been torqued to the specified setting, the front cap is first installed without any shims, and is torqued to a factory predetermined value. The gap between the front cap flange and the gear box housing is measured with feeler gauges at each mounting bolt location. The measured gaps are used to determine the quantity of shims required for proper worm shaft pre-load. The front cap is again removed and the required shims installed between the front cap flange and the gear box housing. The mounting bolts are torqued to specification, and the elevator can be returned to service.

As is evident from the foregoing description, replacing the rear dynamic seal of the worm gear box is a relatively lengthy procedure. While it is also necessary to reset the pre-load on the tapered roller bearings when the front seal is replaced, because the front seal is a static "O" ring replacement is required much less often.

SUMMARY OF THE INVENTION

A geared traction elevator according to the invention comprises a motor, a drive sheave, a gear box housing, and a gear assembly supported in the gear box housing for coupling the motor and drive sheave. The gear assembly includes a worm shaft, one end of which projects out of an opening in the gear box housing and is coupled to the motor. A first bearing assembly rotatably supports the first end of the shaft in the gear box housing, and a second bearing assembly rotatably supports the worm shaft in the opening in the gear box housing. Means are disposed in the opening in the gear box housing for securing the second bearing against axial movement in a direction toward the second end of the worm shaft, and a dynamic seal surrounds the worm shaft and is mounted in the opening for sealing the gear box housing. Means are also provided to urge the first bearing assembly toward the second bearing assembly for applying a selected pre-load to the first and second bearing assemblies in the axial direction. In this manner, the dynamic seal may be replaced without affecting the pre-load setting.

Preferably, the means for securing the second bearing against axial movement comprises a groove in the opening in the gear box housing, and a snap ring disposed in the groove and bearing against the second bearing. Also, the opening in the gear box housing is larger than the maximum diameter of the worm shaft, such that by removing the snap ring the worm shaft may be removed from the gear box housing through the opening.

Preferably, the first bearing assembly is disposed in a second opening in the gear box housing, located opposite the motor side opening. The second opening is closed by a cap which bears against the first bearing assembly and is bolted to the gear box housing to apply the requisite pre-load. Preferably, the second opening is also larger than the maximum diameter of the worm shaft, so that by removing the cap the worm shaft may be removed from the gear box housing through the second opening.

The first and second bearing assemblies preferably are tapered roller bearings, each having an inner race and an outer race. The snap ring and cap, located at opposite ends of the housing, bear against the outer races of the respective bearing assemblies.

In an elevator according to the invention, a worn or damaged worm shaft dynamic seal can be replaced without changing the factory pre-load setting on the worm shaft assembly. This reduces the time and effort necessary to replace the dynamic seal, because re-shimming of the worm shaft is no longer required. The arrangement also simplifies the manufacture of the gear box, by eliminating the need to provide a motor side end cap and associated bolt fasteners. The need to perform a facing operation on the motor end of the gear box housing (which was done for properly seating the motor side end cap against the housing) and to drill and tap holes for the cap mounting bolts are also eliminated, thus reducing machining and manufacturing costs. The arrangement furthermore reduces the number of parts needed to replace the worm shaft seal, because a new rear cap and shim package no longer need to be included in the replacement package.

By using the snap ring in a straight bore for the worm shaft assembly, the shaft assembly may be removed from the motor end of the machine if necessary. This is important in applications where the front of the gear box is up against the machine room wall or other obstruction.

For a better understanding of the invention, reference is made to the following detailed description of a preferred embodiment, taken in conjunction with the drawings accompanying the application.

DETAILED DESCRIPTION OF A PREFERRED EMBODIMENT

Figure 1:
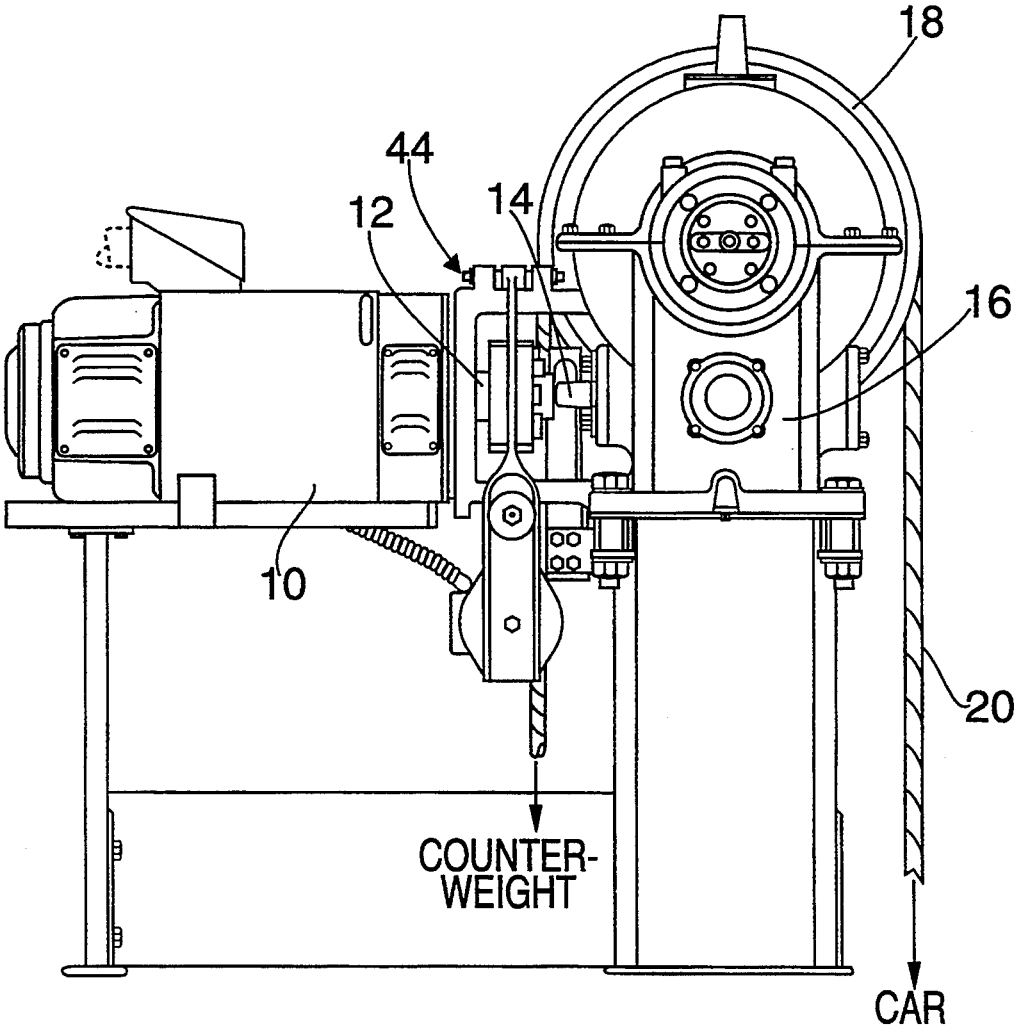
FIG. 1 is side view of a drive for a geared elevator system.
Figure 2:
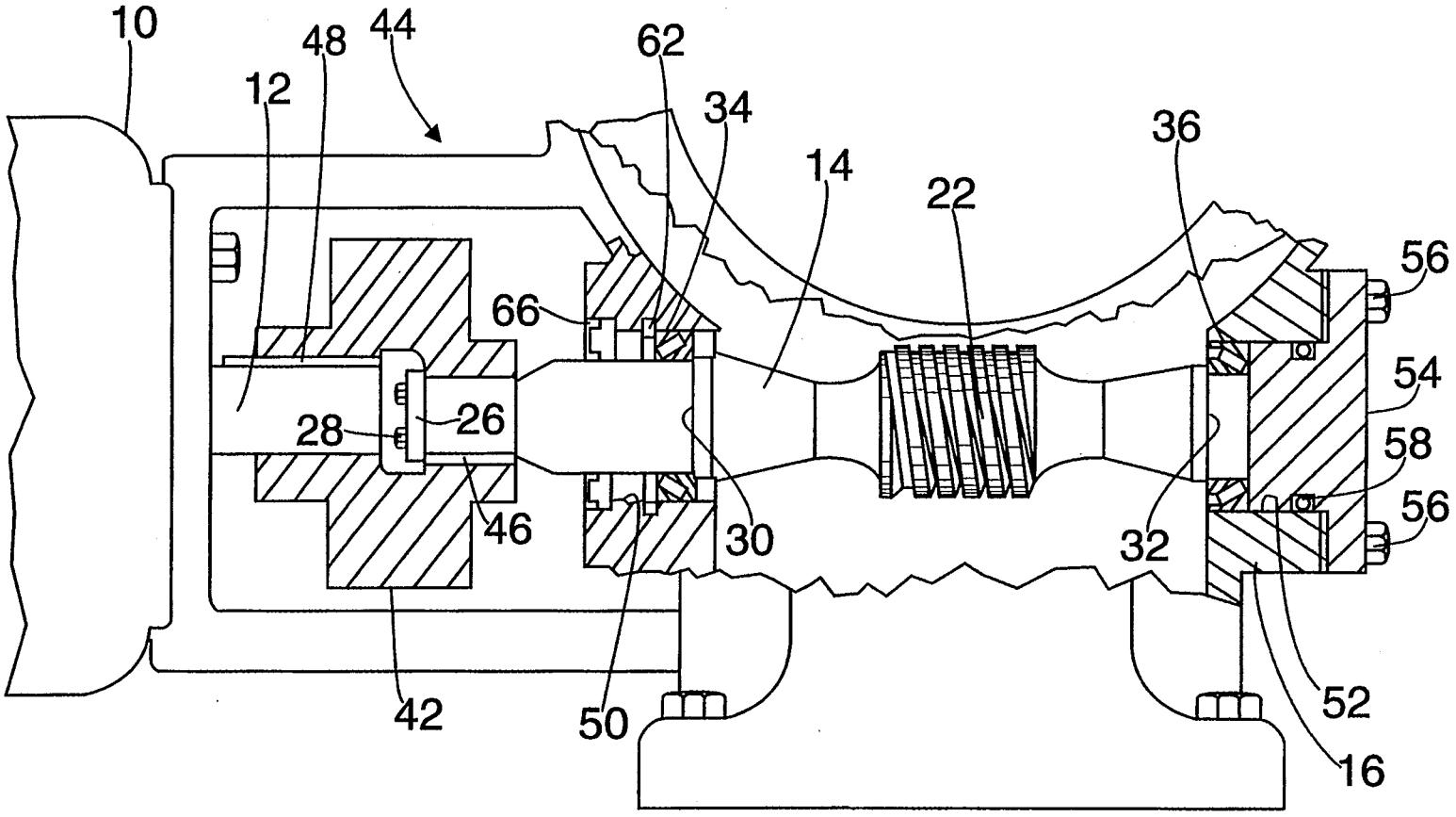
FIG. 2 is a view, partially in section, of a portion of the drive of FIG. 1.

Referring to FIG. 1 and 2, a geared elevator according to the invention includes a drive motor 10, whose output shaft 12 is coupled to the worm shaft 14 of a gear assembly, housed in gear box 16. The output shaft (not shown) of the gear assembly rotates a drive sheave 18, over which are entrained one or more ropes 20 for supporting an elevator car and counterweight.

Figure 3:
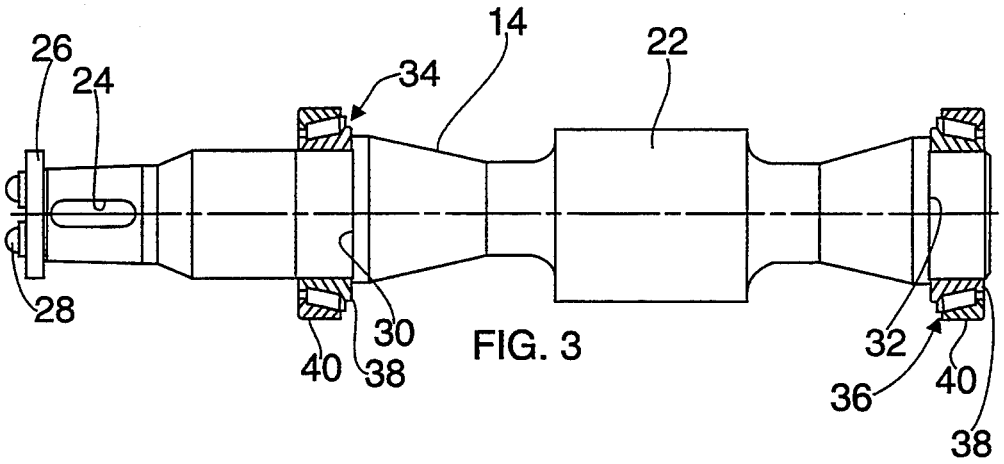
FIG. 3 is a side view of a worm gear and bearings used in the drive of FIGS. 1–2.

Referring to FIGS. 2–3, the worm shaft 14 includes a worm gear 22, and a key opening 24 and bearing plate 26, secured by mounting bolts 28, at the end facing the motor. A pair of bearing shoulders, 30 and 32, are formed on opposite sides of the worm gear 22, against which tapered roller bearings 34, 36 rest. Each bearing 34, 36 includes an inner race 38 and an outer race 40.

As shown in FIG. 2, the motor end of the worm shaft 14 is disposed in an opening in the pulley 42 of the brake assembly 44. The end of the worm shaft is secured to the pulley 42 against axial movement by bearing plate 26 and mounting bolts 28, and is coupled with the pulley for rotation by key 46. The motor shaft 12 is also coupled with the pulley 42 for rotation, by key 48, so that the motor shaft 12, brake pulley 42, and worm shaft 14 rotate as a unit.

The gear box housing 16 has a motor side cylindrical opening 50 and a second cylindrical opening 52 opposite the motor side opening 50. The worm shaft 14 is disposed in the gear box housing 16 so that the motor end projects out opening 50, and so that bearings 34, 36 are disposed in the respective openings 50, 52. The opening 52 is closed off by an end cap 54, which is held by bolts 56 and bears against the outer race 40 of the tapered roller bearing assembly 36. The cap 54 includes an annular groove, in which is disposed an "O" ring 58 to seal the end of the gear box housing. The opening 52, tapered roller bearing 36, and end cap assembly 54, 56, 58 are conventional and therefore need not be described further.

Figure 4:
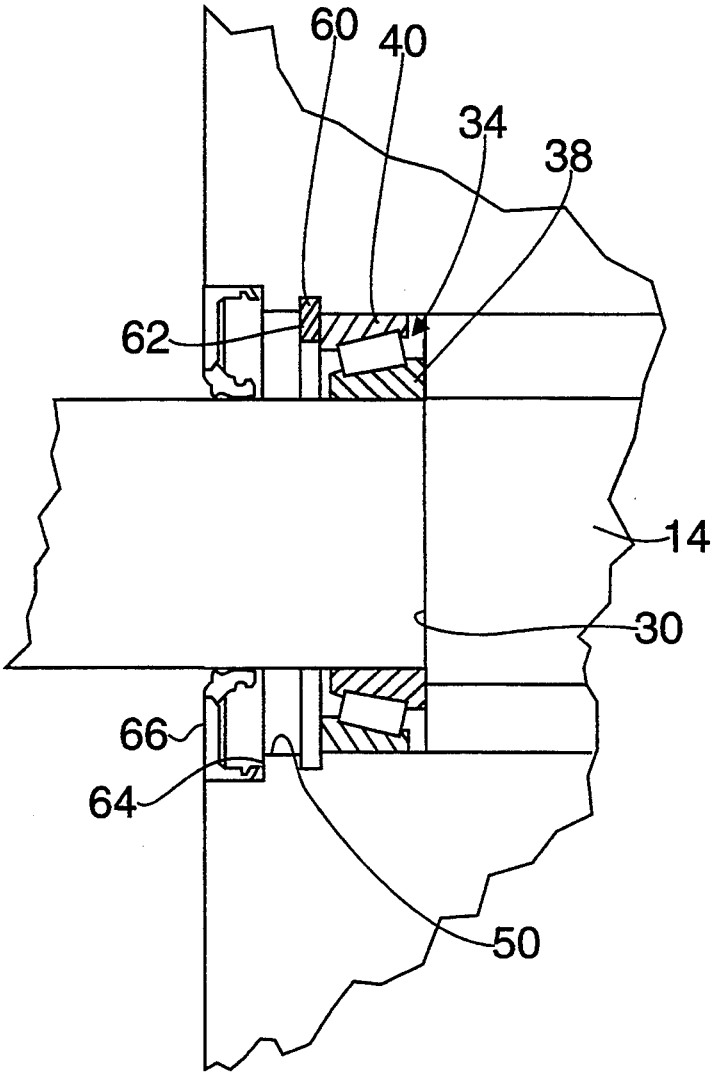
FIG. 4 is a sectional view of the brake end of the gear housing, showing the bearing, seal and retaining structure for the worm gear.

As shown best in FIG. 4, tapered roller bearing 34 is disposed in opening 50 such that its inner race 38 bears against the shoulder 30 formed on the worm shaft 14, and its outer race 40 contacts the inside surface of the cylindrical opening 50. An annular groove 60 is formed in the inside surface of opening 50, adjacent the outer race 40 of the bearing, and a retainer ring 62 is disposed in the groove 60 so as to contact the outer bearing race 40. The outer end 64 of the opening has a counterbore larger in diameter than the remainder of opening 50, to receive a dynamic seal 66, which surrounds the worm shaft 14. An example of a suitable dynamic seal is a model 50-90-8 (19686) manufactured by CR Industries. The seal includes a spring steel casing, slightly larger in diameter than the counterbore, and is press fit into the counterfore to be secured in the worm gear housing opening 64 by friction in a known manner.

The following is an example of the installation of a worm shaft assembly in the worm gear housing 16. By way of example, the shaft 14 has a diameter of 1.9692 inches where the two tapered roller bearings are mounted. With the worm shaft 14 removed from the housing, inner race 38 and rollers of bearing assembly 34, which may be Timken model 92KA1 roller bearings, are heated to approximately 250° F., slid over the motor end of the shaft, and held against the shoulder 30 until the inner race seizes against the shaft 14. The cap end bearing assembly 36 is heated and mounted on the shaft in the same manner, and the shaft is then screwed into the gear box housing 16.

Figure 5:
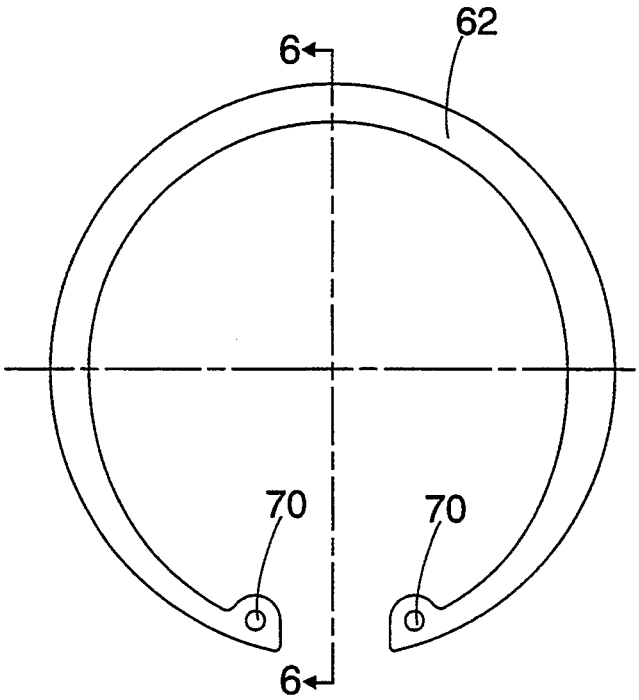
FIG. 5 is a front view of retainer ring used in the brake end of the gear housing.
Figure 6:
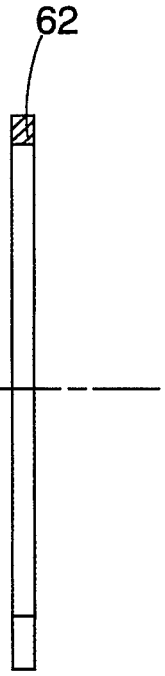
FIG. 6 is a side, sectional view of the retaining ring, taken through lines 6—6 of FIG. 5.

The outer race 40 of the motor end bearing assembly 34 is then positioned in place, and the retainer ring 62 is snapped into the retainer groove 60. As shown in FIG. 5, the retainer ring 62 is preferably a split ring, having holes 70 at the ends, so that the ends can be compressed together to facilitate installation into the groove 60. The dynamic seal 66 may be installed at this time or after mounting the end cap 54.

To install the end cap 54, the outer bearing race 40 of the cap tapered roller bearing 36 is positioned in place, and the cap 54 is installed onto the housing 16 without an O-ring or shims. The mounting bolts 56 are torqued to a predetermined level, e.g., 120 in. lbs., and the gap is measured at each bolt. The cap 54 is then removed and the O-ring and shim pack of appropriate thickness, e.g., 0.001 inches greater than the average gap at each bolt, is assembled. The cap, with the O-ring and shim pack, is then reinserted into the opening 52 and the bolts are torqued to the final predetermined level, e.g., 30 ft.-lbs.

The size of the ring is selected based on the anticipated thrust load. In the exemplary embodiment, the retainer ring is 2.8 mm thick, and made of carbon spring steel (SAE 1060-1090), based on a maximum static thrust load of 1502 lbs. and a minimum factor of safety of 10, per ASME/ANSI standard A17.1.

The foregoing represents a description of preferred embodiments of the invention. Variations and modifications will be evident to persons skilled in the art, without departing from the inventive principles disclosed herein. All such modifications and variations are intended to be within the scope of the invention, as defined in the following claims.

I claim:

1. A geared traction elevator comprising a motor, a drive sheave, a gear box housing, and a gear assembly supported in said gear box housing for coupling the motor and drive sheave, wherein said gear assembly includes:

a worm shaft having first and second ends and a worm gear therebetween, wherein said gear box housing has an opening and said second end of said worm shaft extends out of the opening in said gear box housing and is coupled to said motor, a first bearing assembly for rotatably supporting said first end of said shaft in said gear box housing, and a second bearing assembly for rotatably supporting said worm shaft in the opening in said gear box housing, means disposed in the opening in said gear box housing for securing said second bearing against axial movement in a direction toward said second end of said worm shaft, a dynamic seal surrounding said worm shaft and mounted in the gear box housing between said means for securing said second bearing against axial movement and said second end, and means acting on said first bearing assembly for urging said first bearing assembly toward said second bearing assembly for applying a selected pre-load to said first and second bearing assemblies in the axial direction, wherein said dynamic seal may be replaced without affecting the pre-load setting.

2. An elevator as recited in claim 1, wherein the means for securing said second bearing against axial movement comprises a groove in the opening in said gear box housing, and a snap ring disposed in said groove and bearing against said second bearing.

3. An elevator as recited in claim 2, wherein the opening in said gear box housing is larger than the maximum diameter of said worm shaft, such that by removing said snap ring said worm shaft may be removed from said gear box housing through said opening.

4. An elevator as recited in claim 3, wherein said gear box housing contains an additional opening, in which said first bearing assembly is disposed, wherein the additional opening is larger than the maximum diameter of said worm shaft, wherein said first and second bearing assemblies comprise tapered roller bearings, each having an inner race and an outer race, wherein said snap ring bears against the outer race of said second bearing assembly, wherein the means acting on said first bearing assembly comprises a removable cap bearing against the outer race of said first bearing assembly and covering said additional opening, such that by removing said cap said worm shaft may be removed from said gear box housing through said additional opening.

* * * * *